United States Patent [19]

Myslicki

[11] Patent Number: 4,790,047

[45] Date of Patent: Dec. 13, 1988

[54] HINGE BUSHING ADJUSTMENT MEANS FOR A HINGE ASSEMBLY

[75] Inventor: Robert J. Myslicki, Sterling Heights, Mich.

[73] Assignee: General Motors Corporation, Detroit, Mich.

[21] Appl. No.: 176,959

[22] Filed: Apr. 4, 1988

[51] Int. Cl.[4] ..... E05D 7/12

[52] U.S. Cl. ..... 16/386; 16/273; 16/381

[58] Field of Search ..... 16/386, 273, 380, 381

[56] References Cited

U.S. PATENT DOCUMENTS 3,015,126 1/1962 Ahlgren ..... 16/386
4,675,940 6/1987 Brockhaus ..... 16/273

FOREIGN PATENT DOCUMENTS 807357 3/1969 Canada ..... 16/386
12470 of 1899 United Kingdom ..... 16/264
1137878 12/1968 United Kingdom ..... 16/386

*Primary Examiner*—Nicholas P. Godici
*Assistant Examiner*—Richard K. Seidel
*Attorney, Agent, or Firm*—William A. Schuetz

[57] ABSTRACT

A hinge assembly for hingedly attaching a movable closure to a vehicle body comprises a male hinge member having an integral ferrule, a female hinge member having a pair of spaced ears for straddling the ferrule and a connecting means for pivotally connecting the hinge members together. The connecting means comprises a pair of flanged bushings which are slidably received in the ferrule, a pair of hinge pins which are slidably received in the bushings and force fittingly received in the ears and an adjustment screw threadably received in a threaded opening in the ferrule for engaging the bushings and moving the latter outwardly to seat against the ears on the female hinge member to take up fabrication tolerances and prevent rattling between the hinge members.

5 Claims, 3 Drawing Sheets

HINGE BUSHING ADJUSTMENT MEANS FOR A HINGE ASSEMBLY

The present invention relates to a hinge assembly and, more particularly, to a hinge assembly for hingedly connecting a closure to a vehicle body and which includes an adjustment means to take up fabrication tolerances and prevent rattling.

Heretofore, hinge assemblies for hingedly connecting a vehicle closure, such as a deck lid, hatchback or tailgate, to a vehicle body have been provided. These hinges are usually of a metal die cast or stamped sheet metal construction and include a male hinge member connected to the closure or vehicle body and having a ferrule which is received between two ears or ferrules on a female hinge member connected to the other of the closure or vehicle body, and a hinge pin or pins extending through the ferrules when aligned to pivotally connect the hinge members together. While these known hinge assemblies have been successfully used, rattling noise during operation of the vehicle can occur if close tolerances of the mating hinge parts is not maintained or provided so as to eliminate or minimize play between the parts. The close tolerancing solution to this problem, however, increases the manufacturing costs of the hinge assembly.

Accordingly, in accordance with the provisions of the present invention, a new and improved hinge assembly is provided which incorporates an adjustment means for taking up fabrication tolerances and preventing rattling between the pivotally connected male and female hinge members. To this end, the adjustment means comprises a pair of flanged bushings having adjacent rounded closed ends which are received within the opposite ends of the ferrule of the male hinge member and a tapered adjustment screw threadably engaged with a threaded opening in the ferrule of the male hinge member. The adjustment screw is readily rotatable and engages the rounded ends of the bushings to move the latter away from each other until the flanges thereof engage the spaced ears or ferrules on the female hinge member to take up the tolerance variations. The adjustment screw is tapered and the ends of the bushings are rounded such that the friction between the adjustment screw and the bushings is less than the friction between the mating screw threads of the adjustment screw and the ferrule whereby the adjustment screw will not back out during operation of the vehicle. In addition, the seating of the flanges of the bushing against the ferrules of the female hinge member does not create any excessive friction therebetween so as to interfere with the movement on the vehicle closure between open and closed positions.

Accordingly, an important object of the present invention is to provide a new and improved hinge assembly having a relatively simple and inexpensive adjustment means for taking up fabrication tolerances in the hinge members and preventing rattling therebetween during operation of the vehicle.

Another object of the present invention is to provide a new and improved hinge assembly, as defined in the next preceding object, and in which the adjustment means comprises a pair of flanged bushings having adjacent rounded closed ends which are received within opposite ends of a ferrule on the male hinge member and a tapered adjustment screws threadably engaged with a threaded opening in the ferrule of the male hinge member and in which the adjustment screw can be readily rotated in a tightening direction to engage the rounded ends of the bushings to move the latter away from each other until the flanges thereof engage or abut spaced ears or ferrules on the female hinge member to take up any tolerance variations in the manufacture of the male and female hinge members.

Yet another object of the present invention is to provide a new and improved hinge assembly, as defined in the next preceding object, and in which the adjustment screw has a tapered end for engaging the rounded ends of the bushing and with the taper of the adjustment screw and the curvature of the rounded ends of the bushings being such that the friction therebetween is less than the friction between the screw threads whereby the adjustment screw will not back out during operation of the vehicle.

A still further object of the present invention is to provide a new and improved hinge assembly, as defined in the next preceding object, and in which the bushings are made from a bronze or stainless steel material and the seating of the flanges of the bushings against the ferrules of the female hinge members do not create any excessive friction therebetween so as to interfere with operation of the closure member between its open and closed positions on The present invention further resides in various novel constructions and arrangements of parts, and further objects, novel characteristics and advantages of the present invention will be apparent to those skilled in the art to which it relates and from the following detailed description of the illustrated embodiments thereof made with reference to the accompanying drawings forming a part of this specification and in which similar reference numerals are employed to designate corresponding parts throughout the several views, and in which:

Figure 1:
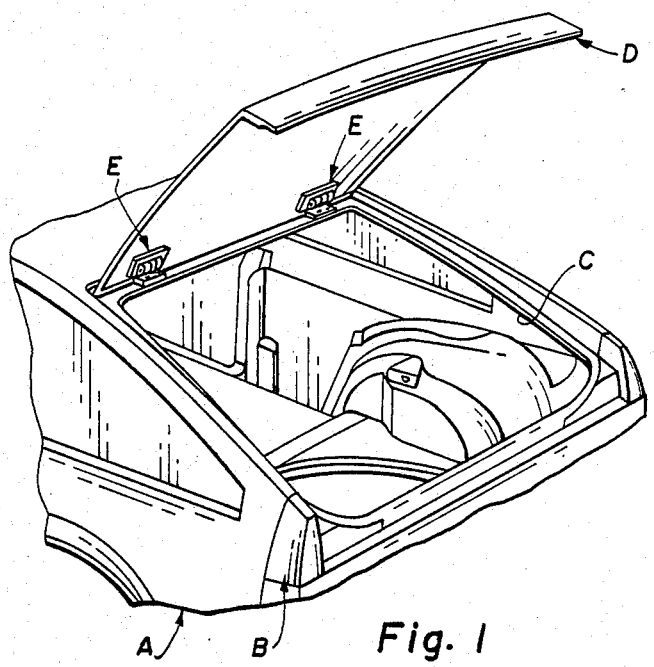
FIG. 1 is a fragmentary perspective view of an automotive vehicle having a hatchback and incorporating the novel hinge assembly of the present invention.

Referring to FIG. 1 of the drawings, an automotive vehicle A is thereshown. The vehicle A has body structure B which defines a rear compartment opening C. The vehicle A further includes a rear closure member in the form of a hatchback D which is pivotally supported at its upper end by the vehicle A adjacent the roof line thereof by a pair of pivotal hinge assemblies E. The hinge assemblies E pivotally support the hatchback D for movement between an open position, as shown in FIG. 1, in which access is permitted to the rear compartment of the vehicle A through the rear compartment opening C and a closed position in which the hatchback D closes off access to the rear compartment of the vehicle A. Since both hinge assemblies E are of an identical construction, only the leftmost hinge assembly E, as viewed in FIG. 1, will be described in detail hereinafter.

Figure 2:
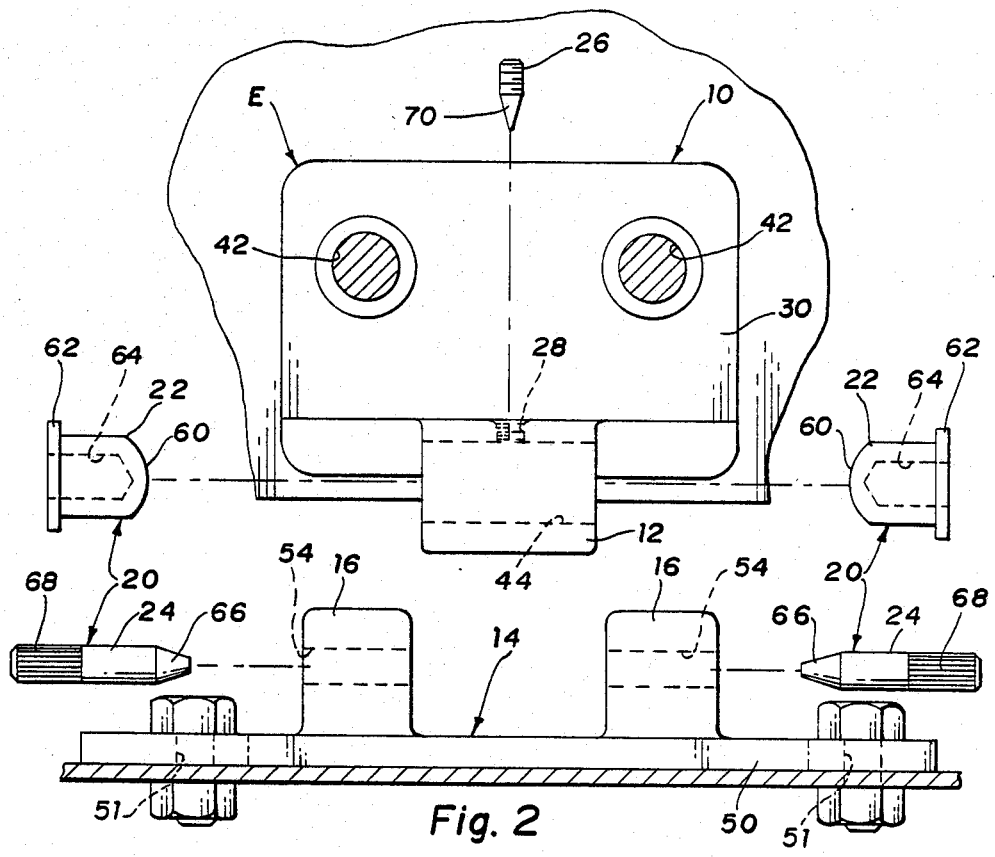
FIG. 2 is an enlarged exploded view of one embodiment of the novel hinge assembly of the present invention.
Figure 3:
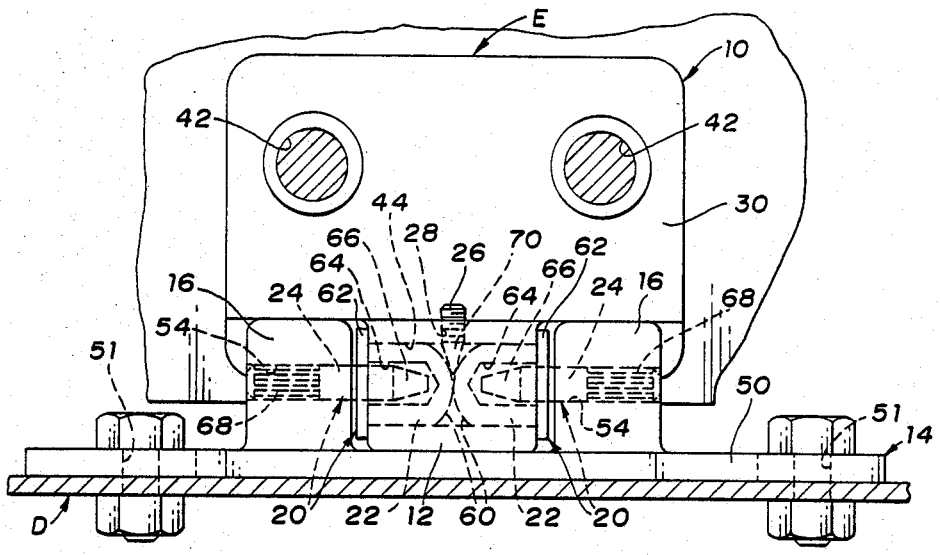
FIG. 3 is a plan view of the hinge assembly shown in FIG. 2, but showing the parts thereof assembled in their initial position.
Figure 4:
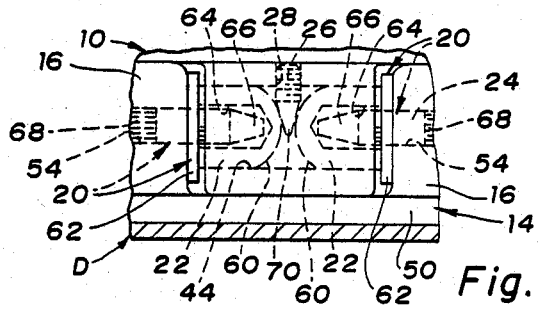
FIG. 4 is a fragmentary plan view of the hinge assembly shown in FIGS. 3, but showing the parts thereof in their final assembled position.

Referring to FIGS. 2–4 of the drawings, a first embodiment of the novel hinge assembly E of the present invention is thereshown. The hinge assembly E comprises, in general, a male hinge member 10 having an integral ferrule 12, a female hinge member 14 having a pair of spaced ears or ferrules 16 and a connecting means 20 for pivotally connecting the male hinge member 10 to the female hinge member 14. The connecting means 20 comprises a pair of flanged bushings 22 which are slidably received within the ferrule 12 on the male hinge member 10, a pair of hinge pins 24 which extends through the ears or ferrules 16 of the female hinge member 14 and extend within the flanged bushings 22 and an adjustment means comprising an adjustment screw 26 threadably engaged with a threaded opening 28 in the ferrule 12 and which is adapted to engage and move the bushings 22 outwardly away from each other and into engagement with the ears 16 of the female hinge member 14 when rotated in a tightening direction to take up any slack or tolerance variations between the hinge members 10 and 14 and to prevent rattling therebetween.

The male hinge member 10 is made from a metal die cast material and comprises a strap or body portion 30 which is generally planar and the integrally formed ferrule 12. The ferrule 12 is in the form of a boss located intermediate the opposite sides of the strap 30, as viewed in FIGS. 2 and 4, and is formed so as to be spaced from the plane of the strap 30. The strap 30 is adapted to be mounted to the vehicle body structure B. To this end, the strap is formed with a pair of spaced openings 42 through which suitable headed fasteners can extend to secure the strap to the vehicle body structure B adjacent the roof line of the vehicle. The ferrule 12 is formed with an opening 44 therethrough and is also provided with a threaded opening 28 in communication with the opening 44 and which extends normal to the axis of the opening 44.

The female hinge member 14 is preferably made from a suitable die cast material and has a planar body or strap 50 and a pair of integrally formed ears or ferrules 16 extending perpendicularly to the plane of the strap 50. The ferrules 16 are in the form of a boss and are formed at spaced locations along the strap, as shown in FIG. 2. The ferrules 16 are spaced a distance apart which is slightly greater than the width of the ferrule 12 of the male hinge member 10 and the ferrule 16 each having an opening 54 extending therethrough, but which is of a lesser diameter than the opening 44 in the male hinge member 10. The female hinge member 14 is adapted to be mounted to the top of the hatchback D. To this end, the strap 50 is provided with a pair of openings 51 through which suitable headed fasteners can extend to secure the strap 50 to the hatchback D.

The male hinge member 10 is adapted to be connected to the female hinge member 14 by positioning the ferrule 12 of the male hinge member 10 between the ferrules 16 on the female hinge member 14 and so that the openings 44 and 54 are aligned and then pivotally connected together by the connecting means 20.

The connecting means 20 comprises a pair of flanged bushings 22, preferably made from a material such as bronze or stainless steel and which are slidably received within the opening 44 of the ferrule 12 of the male hinge member 10. The bushings 22 are generally cylindrical in shape and have a closed rounded or convex end 60 at one end of a predetermined curvature and an enlarged diameter flange 62 at their other end. The bushings have a central opening 64 extending from the flange end 62 to a location adjacent the closed end 60. The bushings 22 have a diameter such that they are slidably received within the opening 44 in the ferrule 12 in the male hinge member 10. The connecting means 20 further includes a pair of metal hinge pins 24 which are tapered at one end, as indicated by reference numeral 66, and which are knurled adjacent their opposite end, as indicated by reference numeral 68. The hinge pins 24 are cylindrical and function to pivotally connect the male hinge member 10 the female hinge member 14. The hinge pins 24 are driven through the openings 54 with the knurled end 68 frictionally engaging the ears or ferrules 16 to position the hinge pin in place, as best shown in FIG. 3.

The male hinge member 10 is adapted to be pivotally connected to the female hinge member 14 by first positioning the bushings 22 within the opening 44 in the ferrule 12 of the male hinge member 10, as shown in FIG. 3, and then aligning the male ferrule 12 with the openings 54 in the ears 16 of the female hinge member 14. Thereafter the hinge pins 24 are inserted through the openings 54 until the knurled end 68 engages the ferrule 16 on the female hinge member 14. Then the hinge pins 24 are driven into the openings 54 of the ears 16 of the female hinge member 14 until the knurled end 68 is completely received within the openings 54, as shown in FIG. 3, the tapered ends 66 of the hinge pins 24 being freely slidably received within the openings 64 in the bushings 22. The hinge pins 24 are thus connected to the ears 16 by a drive or force fit. This pivotally connects the male hinge member 10 to the female hinge member 14.

FIG. 3 shows the initial assembly position after the pivotal connection of the hinge member 10 to the hinge member 14. In this position, relative sideways movement between the hinge member 10 and the hinge member 14 can take place. After the hinge members 10, 14 are initially pivotally connected together, the relative positions are adapted to be adjusted by the novel adjustment means of the present invention.

The adjustment means comprises the adjustment screw 26 which is threadably connected with the threaded opening 28 in the ferrule 12 of the male hinge member 10. The adjustment screw has a tapered end 70 which is engageable with the rounded or convex ends 60 of the bushings 22. When the adjustment screw 26 is rotated in a tightening direction, i.e., clockwise or downward, as viewed in FIG. 3, the tapered end 70 will engage the rounded ends 60 of the bushings 22 and force and move the same outwardly away from each other from the position shown by the solid lines in FIG. 4 until the flanges 62 of the bushings 22 engage and seat against the ears 16, as shown by the dotted lines in FIG. 4. This adjustment takes up all tolerance variations between the ferrules 12, 16 of the hinge member 10 and 14 and prevents rattling or shifting between during operation of the vehicle A.

It should be noted at this point that the taper of the tapered end 70 of the adjustment screw 26 and the convex curvature of the rounded ends 60 of the bushings 22 are such that the frictional force between the screw 26 and the bushings 22 is less than the frictional force between the threads on the adjustment screw 26 and the threads of the threaded opening 28 so that the screw 26 will not back out once the hinge members 10, 14 are in their adjusted position, as shown in FIG. 4. This prevents the adjustment screw 26 from backing out and being loosened during operation of the vehicle A.

Figure 5:
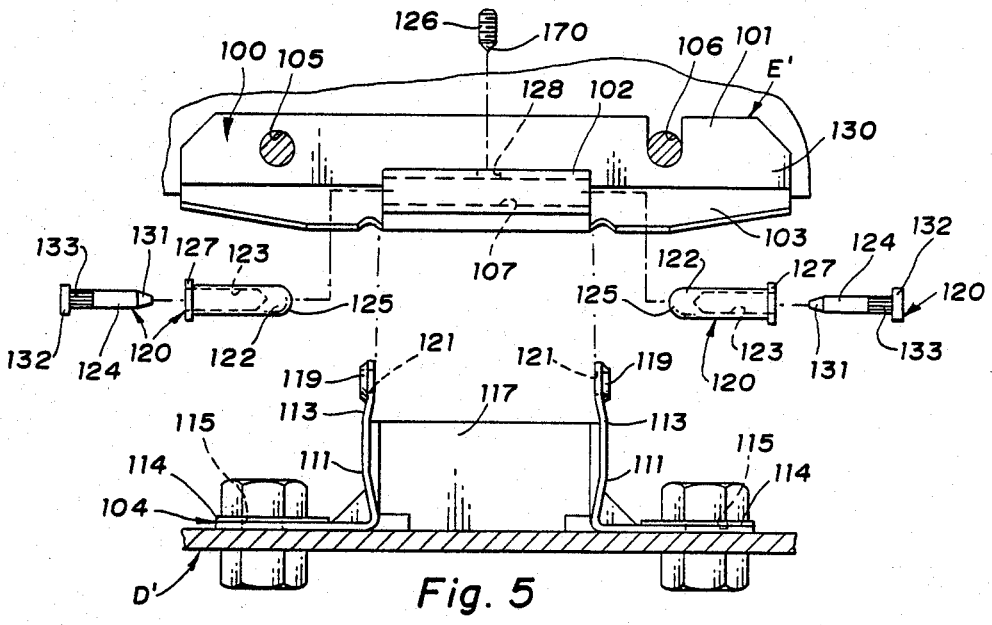
FIG. 5 is an enlarged exploded view of a second embodiment of the novel hinge assembly of the present invention.
Figure 6:
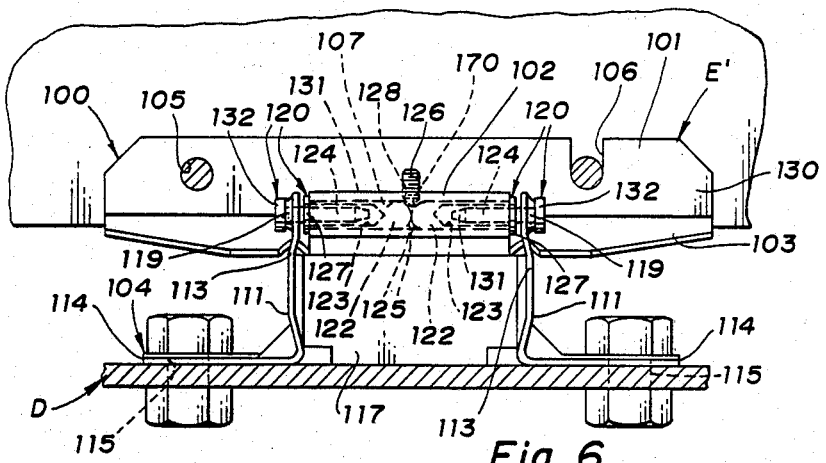
FIG. 6 is a view of the hinge assembly shown in FIG. 5, but showing the parts thereof assembled in their initial position.
Figure 7:
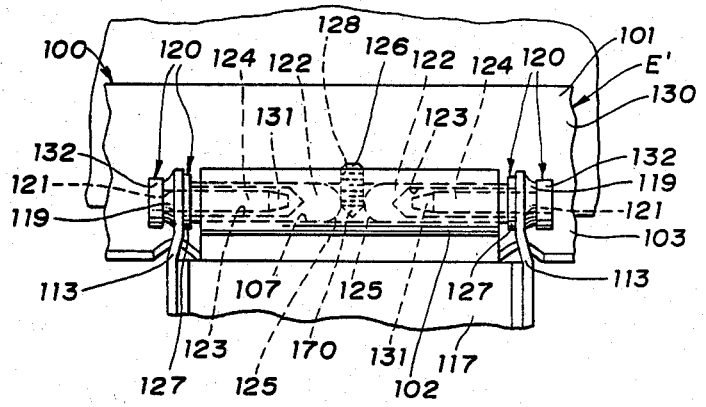
FIG. 7 is a view of parts of the hinge assembly shown in FIG. 6, but showing parts thereof in different positions.

FIGS. 5–7 show an alternate embodiment of a hinge assembly E′ embodying the novel provisions of the present invention. The hinge assembly E′ principally differs from the previously described hinge assembly E in that the hinge members are made from a stamped sheet metal construction instead of a die cast construction and in that the hinge pins are drivingly connected to the bushings rather than to the ears or ferrules of the female hinge member.

As best shown in FIGS. 5 and 6, the hinge assembly E′ comprises a male hinge member 100 which is stamped and bent from suitable sheet metal, such as steel, to the shape shown in FIG. 5. The male hinge member 100 has a main body which is generally L shaped to define a pair of legs 101 and 103. The leg 101 is adapted to be mounted to the vehicle body in any suitable fashion, such as by fasteners extending through an opening 105 and a slot 106. The male hinge member 100 also includes a ferrule 102 which is integral with the leg 103 at its end remote from the leg 101 and which is curled to a circular shape. The ferrule 102 is located intermediate the left and right sides of the hinge member 100 and defines a linearly extending opening 107 therethrough.

The hinge assembly E′ also includes a female hinge member 104 which is stamped from a suitable sheet metal to the shape shown in FIG. 5. The female hinge member 104 is shaped to provide a pair of L-shaped members 111 having first legs 113 which face towards each other and second legs 114 extending normal to the legs 113. The legs 114 have apertures 115 therethrough to enable the female hinge member 104 to be suitably secured to the closure or hatchback D via suitable fasteners extending through the openings 115. The female hinge member 104 also includes a cross member 117 whose opposite ends are integral with the side edges of the legs 113 and which functions to maintain the legs 113 in spaced relationship. The legs 113 are also stamped to provide a pair of bosses or ears 119 at a location above the cross member 117 and with the ears 119 having central through openings 121 pierced therethrough. The spacing between the ears 119 on the female hinge member 104 is such to freely receive the ferrule 102 of the male hinge member 100.

The hinge assembly E′ also includes a connecting means 120 comprising a pair of bushings 122, each having a central opening 123 extending through a major portion of its length. The bushings 122 each have a rounded or convex closed end 125 and an annular flange 127 at its end remote from the closed end 125. The flange 127 has a diameter which is larger than the diameter of the remainder of the bushing 122. The connecting means 120 further includes a pair of hinge pins 124 having a cylindrical shank 131 and a head 132 at one end of the shank 131. The shank 131 adjacent the head is knurled to define a knurled portion, as indicated by reference numeral 133.

The male hinge member 100 is connected to the female hinge member 104 by first slidably inserting the bushings 122 within the ferrule 102 of the male hinge member 100. The diameter of the bushings is slightly less than the diameter of the opening 107 in the ferrule 102. Thereafter the ferrule 102 of the male member 100, with the bushings 122 inserted therein, is positioned between the ears 119 of the female hinge member 104 so that the openings 123 in the bushings 122 are aligned with the openings 121 in the ears 119. Then the hinge pins 124 are slidably received within the central openings 123 of the bushings 122 and driven into the ears 119. The hinge pins 124 have a force fit with the ears 119 and when the hinge pins 124 are driven therein the knurled portions 133 will be drivingly connected to the ears 119 of the female hinge member 104. The hinge pins 124 are driven into the bushings 122 until the heads 132 thereof engage the ears 119 on the female hinge member 104. FIG. 6 shows the position of the parts as thus far assembled.

After the male hinge member 100 is connected to the female hinge member 104, as shown in FIG. 6, and in order to prevent rattling between the hinge members 100 and 104, the bushings 122 are driven outboard and away from one another until the flanges 127 thereof are in engagement with the ears 119, as best shown in FIG. 7. That is, when the hinge members 100 and 104 are initially pivotally connected together they have the position shown in FIG. 6. Then by driving the bushings 122 outboard until the flanges 127 engage the ears 119, as best shown in FIG. 7, any tolerance or fabrication variations are taken up to prevent any rattling between the hinge members 100 and 104.

To this end, an adjustment means in the form of an adjustment screw 126 and a threaded opening 128 in the ferrule 102 and extending normal to the opening 107 is provided. The threaded opening 128 is in communication with the opening 107. When the adjustment screw 126 is threadably received within the opening 128 and then rotated in a tightening direction, i.e., clockwise or downward, its tapered end 170 will engage the rounded ends 125 of the bushings 122 and force the bushings 122 to slide within the opening 107 in the ferrule 102 until the flanges 127 are seated or abut against the ears 119 on the female hinge member 104.

The taper 170 of the adjustment screw 126 and the curvature of the rounded or convex ends 125 of the bushings 122 is such that when the bushings 122 are seated against the ears 119 of the female hinge member 104, the friction therebetween is less than the friction between the screw threads of the adjustment screw 126 and the threaded opening 128 so that the adjustment screw 126 will not back out due to vibrations, etc., during operation of the vehicle A. Also, the friction between the flanges 127 of the bushings !22 and ears 119 upon the bushings 122 being seated thereagainst is such that it does not prevent free operation of the hatchback D between its open and closed positions.

From the foregoing, it should be apparent that the hinge assemblies E and E′ of the present invention provide a novel, simple adjustment means to take up fabrication tolerances between the male and female hinge members so that rattling therebetween during operation of a vehicle will not occur. It should also be apparent that the novel adjustment means enables the hinge members to be initially made with larger tolerance variations and thus provides for a more economical hinge assembly construction.

Although the illustrated embodiments hereof have been described in great detail, it should be apparent that certain modifications, changes and adaptations may be made in the illustrated embodiments, and that it is intended to cover all such modifications, changes and adaptations which come within the spirit of the present invention.

The embodiments of the invention in which an exclusive property or privilege is claimed are defined as follows.

1. A hinge assembly for use in hingedly attaching a movable closure to a vehicle body comprising a male hinge member which is adapted to be secured to one of said closure and vehicle body, said male hinge member including an integral ferrule having an opening therethrough and which is located intermediate its opposite sides, a female hinge member which is adapted to be secured to the other of said closure and vehicle body, said female hinge member including a pair of spaced ears having aligned openings therethrough, said ears straddling said ferrule and with the opening in the latter being aligned with the openings in said ears, and connecting means including hinge pin means for pivotally connecting said male and female hinge members together for relative pivotal movement, the improvement being that said connecting means comprising first and second bushings which are slidably received within opposite end portions of the opening in said ferrule, said bushings at one end having flanges for engaging the adjacent end of the ferrule and at their adjacently located ends being rounded, first and second hinge pins which extends through said ears and into said first and second bushings to connect the hinge members together, and adjustment means for accommodating fabricating tolerances in said hinge members and to prevent rattling therebetween, said adjustment means comprising an adjustment screw threadably received in a threaded opening in said ferrule between said first and second hinge bushings, said screw having a tapered bushing engaging end which engages and forces the bushings outboard until the flanges thereof engage the ears on the female hinge member when the screw is rotated in a tightening direction and with the friction between the screw and the bushing being less than the friction between the screw threads whereby the screw will not back out during operation of the vehicle.

2. A hinge assembly according to claim 1 and wherein the bushings are made from a metallic material.

3. A hinge assembly for use in hingedly attaching a movable closure to a vehicle body comprising a die cast male hinge member which is adapted to be secured to one of the closure and vehicle body, the male hinge member including an integrally formed ferrule having an opening therethrough and which is located intermediate its opposite sides, a die cast female hinge member which is adapted to be secured to the other of said closure and vehicle body, said female hinge member including a pair of spaced integrally formed ears having aligned openings therethrough, said ears straddling said ferrule and with the opening in the latter being aligned with the opening in said ears, connecting means including hinge pin means for pivotally connecting said male and female hinge members together for relative pivotal movement therebetween, the improvement being that the connecting means comprises first and second bushings which are slidably received within opposite end portions of the opening in said ferrule, said bushings at one end having flanges for engaging the adjacent end of the ferrule and at their adjacently located ends being rounded and closed, first and second hinge pins which extend through said ears and are slidably received within said first and second bushings, said hinge pins having end portions which are knurled and force fittingly received within said ears to retain the hinge pins in place within the ears to connect the hinge members together, and an adjustment means for accommodating fabrication tolerances in said hinge members and to prevent rattling therebetween, said adjustment means comprising an adjustment screw threadably received in a threaded opening in said ferrule between said first and second hinge bushings, said screw having a tapered bushing engaging end which engages the rounded ends of said bushings and forces the latter outboard until the flanges thereof engage the ears on the female hinge member, the taper of the tapered end of the threaded screw and the curvature of the rounded ends of the bushings being such that the friction between the tapered end and the bushings is less than the friction between the screw threads whereby the screw will not back out during operation of the vehicle.

4. A hinge assembly for use in hingedly attaching a movable closure to a vehicle body comprising:

a stamped sheet metal male hinge member which is adapted to be secured to one of the closure member and vehicle body, the male hinge member including an integrally formed ferrule having an opening therethrough and located intermediate its opposite sides, a stamped sheet metal female hinge member which is adapted to be secured to the other of the closure and vehicle body, said female hinge member including a pair of spaced ears having aligned openings therethrough, the ears straddling said ferrule and with the openings in the latter being aligned with the openings in said ears, connecting means including hinge pin means for pivotally connecting said male and female hinge members together for relative pivotal movement therebetween, the improvement being that said connecting means comprising first and second bushings which are slidably received within opposite end portions of the opening in said ferrule, said bushings at one end having flanges for engaging the adjacent end of the ferrule and at their opposite ends being closed and rounded, first and second hinge pins having a shank, a head at one end and a knurled portion on said shank adjacent said head, each of said pins extending through one of said ears and with the shank being slidably received on said bushings and the knurled portion force fittingly received in said ears, to connect the hinge members together, and an adjustment means for accommodating fabrication tolerances in said hinge members and to prevent rattling therebetween, said adjustment means comprising an adjustment screw threadably received in a threaded opening in said ferrule between said first and second hinge bushings, said screw having a tapered bushing engaging end which engages and forces the bushings outboard until the flanges engages the ears on the female hinge member and with the friction between the tapered end of said screw and the bushings being less than the friction between the screw threads whereby the screw will not back out during vehicle operation.

5. A hinge assembly according to claim 4 and wherein the bushings are made from a metallic material.

* * * * *